US006233797B1

(12) United States Patent
Neely et al.

(10) Patent No.: US 6,233,797 B1
(45) Date of Patent: May 22, 2001

(54) FELT NEEDLE

(75) Inventors: Bill Neely, Charlotte, NC (US); Gustav Wizemann, Messstetten-Hossingen (DE)

(73) Assignee: Groz Beckert KG, Albstadt (DE)

( * ) Notice: Subject to any disclaimer, the term of this patent is extended or adjusted under 35 U.S.C. 154(b) by 0 days.

(21) Appl. No.: 09/352,369

(22) Filed: Jul. 13, 1999

(51) Int. Cl.[7] ..... D04H 18/00
(52) U.S. Cl. ..... 28/115
(58) Field of Search ..... 28/115, 107, 109, 28/111, 113, 114; 112/222; 223/102, 103, 104; 289/16

(56) References Cited

U.S. PATENT DOCUMENTS

| | | | | |
|---|---|---|---|---|
| 2,857,650 | * | 10/1958 | Lauterbach | 28/115 |
| 2,883,585 | * | 4/1959 | Weickert | 28/115 |
| 3,309,753 | * | 3/1967 | Astor | 28/115 |
| 3,347,192 | * | 10/1967 | Lukins | 112/222 |
| 3,542,632 | * | 11/1970 | Eickhoff | 28/115 |
| 3,727,276 | * | 4/1973 | Foster | 28/115 |
| 3,753,412 | * | 8/1973 | Shepard et al. | 28/115 |
| 3,844,004 | | 10/1974 | Foster . | |
| 3,877,120 | * | 4/1975 | Okamoto et al. | 28/115 |
| 4,131,978 | | 1/1979 | Zocher . | |

FOREIGN PATENT DOCUMENTS

| | | | | |
|---|---|---|---|---|
| 233141 | * | 9/1959 | (AU) | 28/115 |
| 343353 | | 2/1960 | (CH) . | |
| 1 227 986 | | 4/1971 | (GB) . | |

* cited by examiner

*Primary Examiner*—Amy B. Vanatta
(74) *Attorney, Agent, or Firm*—Venable; Gabor J. Kelemen

(57) ABSTRACT

A transition part is provided for a felt needle between the clamping part and the working part, which transition part is designed as elongated, narrow truncated cone. The length of this transition part is at least as long as twice the length of the working part. As a result, a very narrow transition region is formed, which has little tendency to pull out and accumulate fibers from the fibrous web. Should fiber deposits still form, these can be removed easily.

14 Claims, 5 Drawing Sheets

FELT NEEDLE

BACKGROUND OF THE INVENTION

This invention relates to a felt needle to be fastened to a needle board and is of the type which has an elongated needle body that includes a clamping part and a working part which is provided with hooks along its length. The clamping part has a larger diameter than the working part. The felt needle further has a transitional part formed between the working part and the clamping part. The transitional part comprises a region whose diameter decreases from the size of the clamping part diameter to the size of the working part diameter.

For the production of felt, loose fibers that are arranged in a random order one above the other are guided through a machine, between a stripper plate having many holes and a base plate, which is also provided with holes. This fiber blend is repeatedly punctured with a larger number of special needles (felt needles). In the process, these felt needles cause a mutual bonding of the fibers, so that the fiber band gradually becomes more compact and, in the final analysis, a tight felt is produced. In addition to natural fibers and synthetic fibers, recycled fibers are also used. However, these generally have a higher tendency to adhere to the needles and form deposits.

Deposits are formed following a certain period of time during which the feltproducing machine is in operation. The deposits can accumulate on the needles, such that the needles can no longer penetrate the holes in the stripper plate. These deposits cause needle breaks and loss of production. As soon as the depositing process starts, the flow of air between the needles is negatively influenced, thereby causing the deposits to build up even faster. In order to clean the needles, the production must be interrupted. Needle breaks frequently occur during the cleaning.

The material is compacted during the needle-punching process. At the beginning, meaning prior to the needle-punching process, the material is relatively loose and voluminous. Once the needle with its shank region or the intermediate region penetrates the material, it produces holes with the diameter of the shank or the intermediate section, which is larger than the diameter of the working part. This results in a poor surface quality of the felt.

Felt needles with a long, straight shank are known from the German Patent 1760440 C3. The upper end of the shank is angled so that it can be clamped into a needle board. At the other end, the shank is tapered to form a reduced cross section and is furthermore provided with hooks. This section forms a working part, which is used for felting the fibrous web.

The transition between the working part and the remaining shank that serves as clamping part is relatively steep.

The German Published Patent Application 3704471 A1 discloses a device for needle-punching a mineral fiber web. The felt needles that are fastened to a needle board extend parallel to each other away from the needle board and through corresponding openings in a stripper plate. A gap forms between this plate and a base plate that is also provided with openings for the felt needles. The fibrous web is guided through this gap. The felt needles have a cylindrical shank that is angled at the top and is relatively thick. A section of this shank is held in the needle board. A transition region, which is barely longer than the diameter of the shank region, is formed between the clamping part and the toothed working part.

Deposits can form on the cylindrical shank.

German Published Patent Application 2222881 discloses a forked needle with a toothless working region. This working region is connected via a conical intermediate region to a cylindrical shank. The working part has a smooth finish on the outside and is provided with a mouth-shaped fork only at its free end. Depending on the embodiment, a more or less steep transition region in the form of a cone can be provided.

Forked needles are used for structuring compacted fibrous webs in a subsequent operation. Owing to the smooth, toothless flanks of the working part, they have little tendency to pull out fibers from the fibrous web and to carry these along.

Additional felt needles with toothed working parts are known from the U.S. Pat. No. 3,753,412. A relatively short transition part is arranged between the respectively toothed working part and a cylindrical shank.

Felt needles with toothed working parts have a tendency to accumulate fibers on their shanks, which are pulled from the compacted fiber material. During the needle punching of the fibers, the shank extends partially into the working space between stripper plate and base plate. The fibers pulled out from the material are deposited in the form of fiber rings, which are moved from the relatively narrow working part across the short transition region and onto the cylindrical shank region between needle board and stripper plate. In the process, they are expanded and pulled tight. If these deposits exceed a tolerable measure, the puncturing of the web by the needles is obstructed because the needle board no longer can be moved close enough to the stripper plate. Thus, cleaning actions are required from time to time, depending on the fibrous web material used. Owing to the high number of needles on a needle board, such a cleaning action is time-consuming and arduous.

SUMMARY OF THE INVENTION

It is an object of the invention to facilitate the cleaning of the needles and/or to reduce the tendency of the needles to accumulate fibers.

This object and others to become apparent as the specification progresses, are accomplished by the invention, according to which, briefly stated, the felt needle includes a clamping length portion for securement to a needle board and a working length portion spaced from the clamping length portion and provided with hooks along its length. A transition length portion is formed between the clamping and working length portions. The transition length portion includes a length region having a diameter decreasing from the diameter of the clamping length portion down to the diameter of the working length portion. The length region of the transition length portion has a length which is at least twice the length of the working length portion.

The remarkable feature of the needle according to the invention is that a relatively narrow transition part or transition region is formed between the toothed working part and the toothless clamping part. This region has at least one segment in which the diameter decreases gradually from the shank diameter to the working part diameter. The length of this region, which can also be divided into several partial regions if necessary, on the whole is at least twice as long as the toothed working part. Thus, the length of the transition region for needle boards having a standard strength or thickness is longer than the respective thickness of the needle board.

In addition, the transition region preferably occupies the complete space between the needle board and the respective working part. A narrow transition region results, which leads to fewer deposits forming on the needle. The deposited fiber rings are expanded only slightly, which means they will not adhere as strongly in the transition region. However, whenever deposits are formed, the cleaning of the respective needles is made easier by the long transition part. It is easier to strip or remove lint rings on the needles, as well as fibers that have accumulated between the needles.

As a result of the gradual transition from the large shank diameter of the clamping part to the small diameter for the working part, the breaking characteristics and the flexibility of the needles are improved. Stress concentrations in the transition region are avoided.

From this it follows that the working part of the needle can have a narrower design than for traditional needles. The transition region preferably is longer than 11 mm and, even more preferable, longer than 20 mm.

Furthermore, it has proven to be advantageous that the needle according to the invention can replace many different types of existing needles. The needle according to the invention can replace felt needles with single, double or triple diameter reduction. As a result of this, the type variety that must be offered by the needle manufacturer is reduced.

Another advantage is the fact that the shank region, which enters the working region between stripper plate and base plate during the needle-punching operation, has a smaller diameter than the traditional needles. Consequently, the openings caused by the shank region in the produced felt have a smaller diameter, which improves the surface quality of the felt.

The transition region preferably is designed as one piece with a conical shape. The cone can be a straight truncated circular cone, meaning a surface line generatrix on this region is a straight line. Alternatively, the cone can also be a non-straight cone. In that case, the transition part has a curved surface line.

The working part and the clamping part for the needle according to the invention are preferably arranged coaxially to each other. However, it is possible to deviate from this if necessary. The working part furthermore preferably has a constant diameter and adjoins the transition part smoothly, preferably without a change in diameter.

According to a further embodiment, the transition part occupies the complete space between the needle board and the working part. The total length of the transition part can be less than twice the working part length owing to the needle dimensions. In that case, the needle consists of three regions: working part, transition part and shank part, which is embedded completely in the needle board.

It is advantageous in this case if the transition part is longer than the thickness of the needle board provided for fastening the needles. Regardless of the total length of the transition part, the transition part for the inventive embodiment starts directly at the needle board.

DESCRIPTION OF THE PREFERRED EMBODIMENTS

Figure 1:
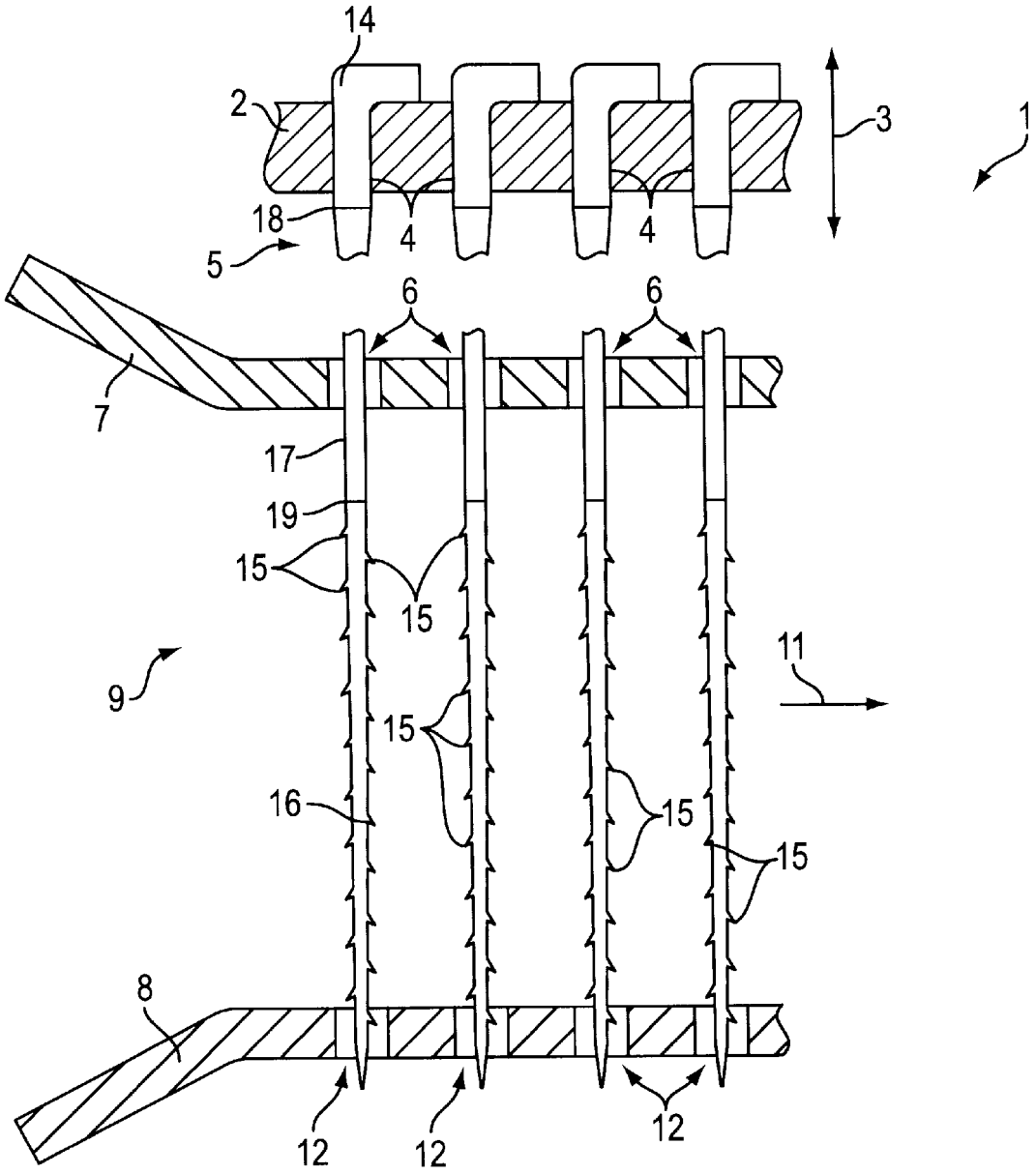
FIG. 1 is a side elevational view, partially in section, of a device for needle punching a felt, according to a preferred embodiment of the invention.

FIG. 1 illustrates a device 1 for needle-punching a fibrous web. The device 1 includes a needle board 2, which is driven, for example, via an eccentric cam plate and performs a back and forth movement in a direction illustrated by an arrow 3. The needle board 2 contains openings 4 for holding and storing the needles 5. The needles 5 extend outward from the needle board 2 parallel to and spaced from each other. They project through stripping openings 6 that are formed in a stripper plate 7. This plate is arranged at some distance to a base plate 8 and together with this plate defines an intermediate space 9 through which loose and randomly distributed fibers are guided in a direction indicated by arrow 11. During the subsequent process, these fibers are compacted to form a fibrous web, as a result of the up and down movement of the needles 5.

The base plate 8 is provided with openings 12, wherein respectively one opening 12 in the base plate 8 is aligned with one opening 6 in the stripper plate 7.

The needles 5 are designed identically. Each needle comprises a clamping part 14 that is held in the needle board 2, as well as a working part 16, which is provided with barbs or hooks 15. A transition part 17 is arranged between the clamping part 14 and the working part 16. The transition part 17 extends from the clamping part 14 to the working part 16 and starts immediately adjacent to the needle board 2.

Figure 2:
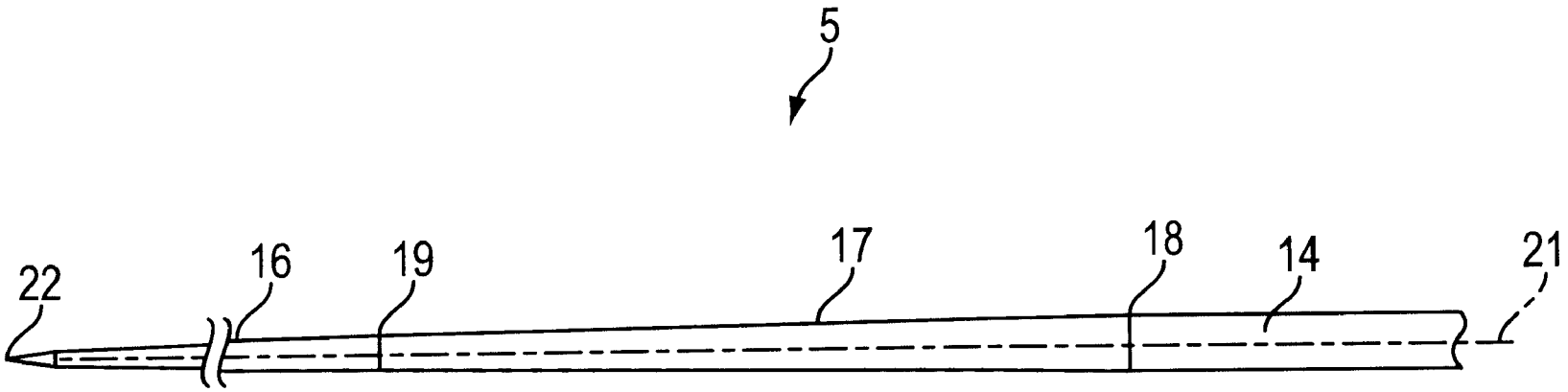
FIG. 2 is a schematic side elevational view of a needle of the device shown in FIG. 1.

In FIG. 2, a needle 5 is shown in order to demonstrate the proportions. The cylinder-shaped clamping part 14 changes at a transition location 18 to the transition part 17, which has the form of a narrow cone. In the transition part 17, the size of the diameter changes from a larger size at the transition location 18 to a smaller size at a transition location 19 where the working part 16 begins. The transition part 17 is arranged coaxially to a longitudinal axis 21 of needle 5 and, on the whole, forms a coherent region for the diameter adaptation. The clamping part 14 and the working part 16 are also arranged coaxially to the longitudinal axis 21. The diameter of the transition part 17 decreases continuously and linearly along the longitudinal axis 21. The length of the transition part 17 measured between transition locations 18 and 19, is at least twice as long as the length of the working part 16, meaning the distance of transition location 19 to a tip 22, formed at the free end of needle 5. As a result, the transition part becomes very narrow and long and has no steps or projections whatsoever.

The device 1 operates as follows:

During the operation, loose fibers are guided through the intermediate space 9. In the process, the needle board 2 is moved in quick succession back and forth in the direction of arrow 3, in such a way that the needles 5 periodically release and puncture the intermediate space 9. The hooks 15 of the working parts 16 in the process compact the individual fibers to form a fibrous web. The danger that individual fiber filaments are carried along, are pulled through the stripping openings 6 and are then deposited on the needle 5 exists during this process especially for the first needles, which come in contact with the as yet non-compacted fibers. The long and narrow design of the transition parts 17 for the needles 5 according to the invention counteracts this tendency. The needles 5 pull fewer fibers through the stripping openings 6, especially with some fibrous web materials and in particular with recycled fibers. As a result of this, less lint if any at all will accumulate between the needle board 2 and the stripper plate 7. However, if fibers should nevertheless accumulate on the needles 5, between the needle board 2 and the stripper plate 7, these can be stripped relatively easily from the narrow transition regions 17. This is particularly true if the transition location 18 is immediately adjacent to the underside of the needle board 2, in contrast to the location shown in FIG. 1.

Figure 3:
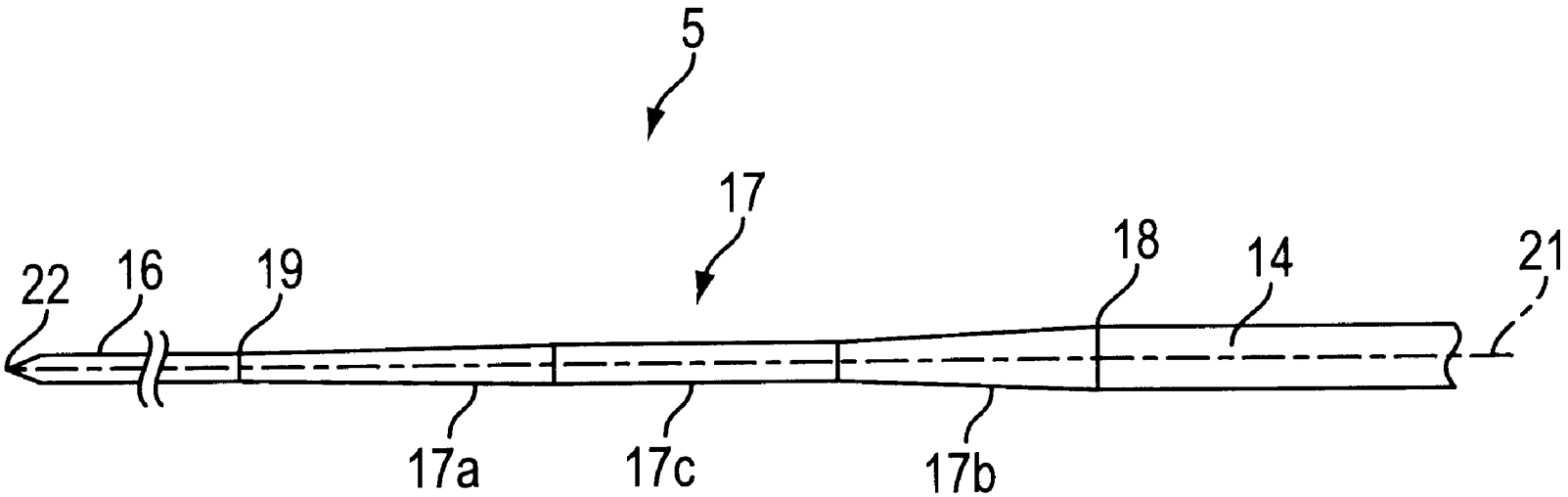
FIG. 3 is a schematic side elevational view of another preferred embodiment of a needle of the device shown in FIG. 1.

FIG. 3 shows a somewhat modified embodiment of the needle 5. The region formed by the transition part 17 is divided into two partial regions 17*a*, 17*b* in which the diameter of needle 5 is reduced from the shank diameter to the working part diameter. The partial region 17*a* in this case borders on the transition location 19, while the partial region 17*b* borders on the transition location 18. A cylindrical intermediate section 17*c* is formed between the partial regions 17*a*, 17*b*. It is true for this embodiment as well that the transition part 17 advantageously starts immediately following the needle board 2, meaning the transition location 18 is aligned with the underside of the needle board 2. The partial regions 17*a*, 17*b*, in which a tapering of the needle 5 occurs, together have a length that is equal to or longer than twice the length of the working part 16, meaning the distance between the transition location 19 and the tip 22.

Figure 4:
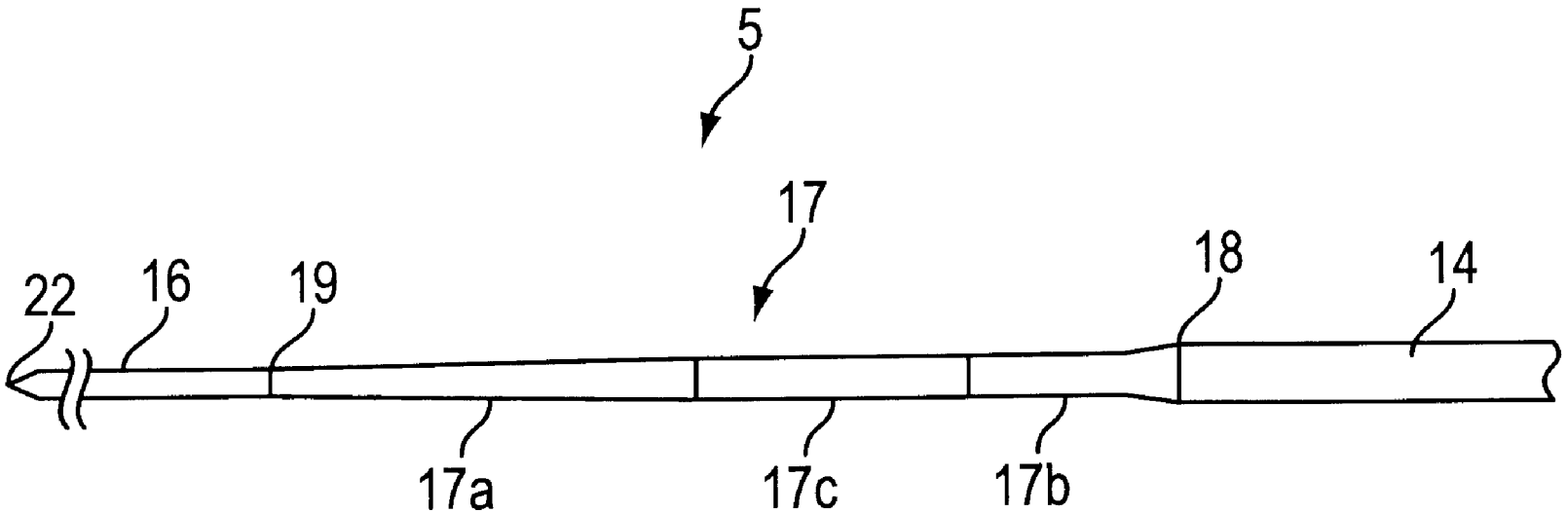
FIG. 4 is a schematic side elevational view of a further preferred embodiment of a needle of the device shown in FIG. 1.
Figure 5:
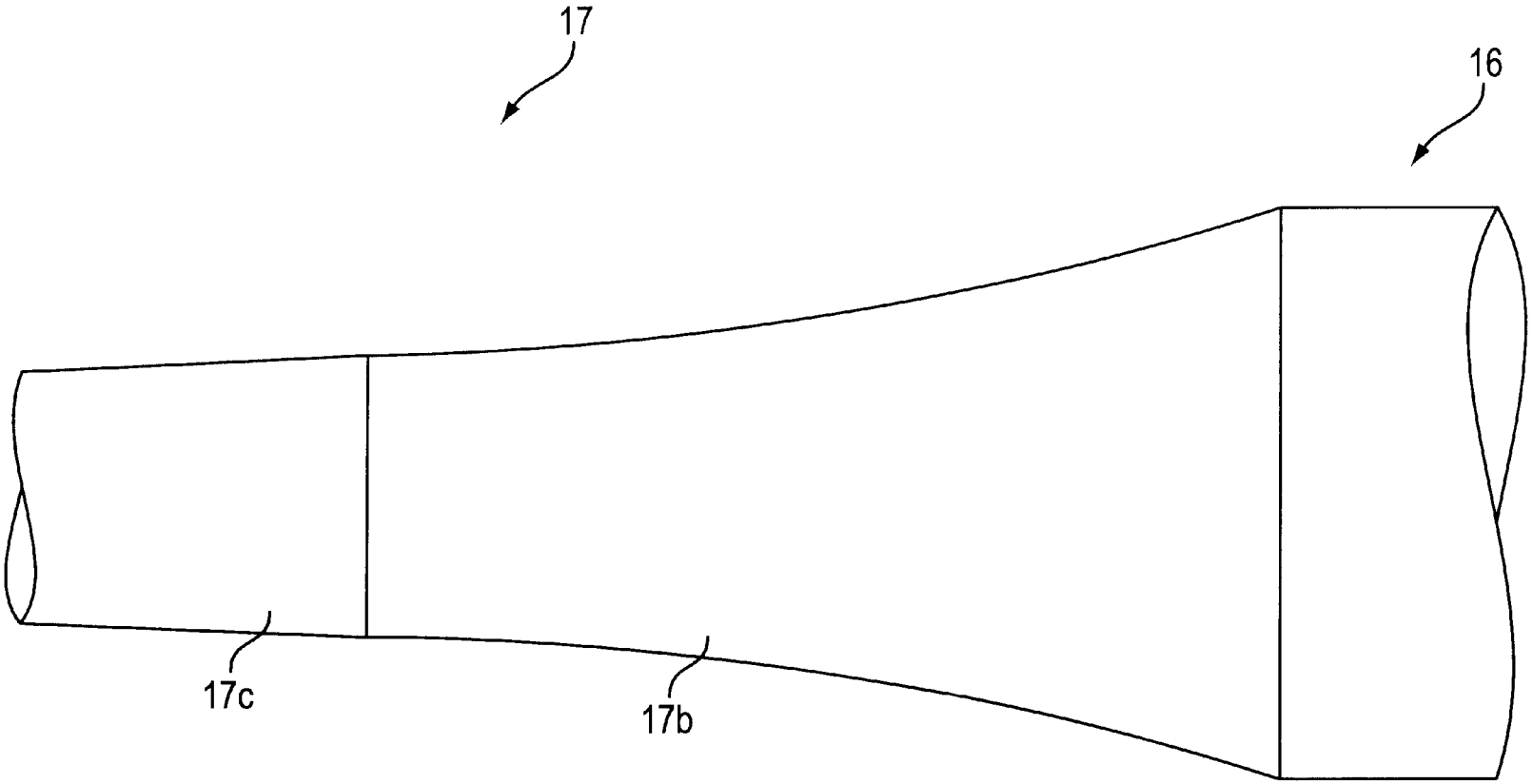
FIG. 5 is a fragmentary side elevational view of the needle shown in FIG. 4, illustrated at a greatly enlarged scale.

The latter applies correspondingly to the embodiment of needle 5 that is illustrated in FIGS. 4 and 5. The above description applies correspondingly, but with one exception. The partial regions 17*a*, 17*b* respectively are located on the surface shell of a small cone, meaning the diameter is reduced in these partial regions 17*a*, 17*b* in the direction of the tip 22. The diameter reduction for the embodiment according to FIG. 4 is linear for the partial region 17*a*, but not for the partial region 17*b*. In the embodiment according to FIG. 4, this is true for the partial region 17*a*, but not the partial region 17*b*. Starting with the transition location 18, the diameter in this region initially tapers off more strongly and then less strongly. Thus, the outline for the cone that forms is a curved line. Such a cone can also be formed in place of the cone in the partial region 17*a* or, for the embodiment according to FIG. 2, in place of the straight, narrow truncated cone in the transition region 17.

It will be understood that the above description of the present invention is susceptible to various modifications, changes and adaptations, and the same are intended to be comprehended within the meaning and range of equivalents of the appended claims.

LIST OF REFERENCE NUMBERS

1 device
2 needle board
3 arrow
4 openings
5 needles
6 stripping openings
7 stripper plate
8 base plate
9 intermediate space
10 arrow
11 openings
14 clamping part
15 hook
16 working part
17 transition part
17*a* partial region
17*b* partial region
17*c* intermediate section
18 transition location
19 transition location
21 longitudinal axis
22 tip

What is claimed is:

1. A felt needle comprising (a) a clamping length portion for securement to a needle board; said clamping length portion having a first diameter;

(b) a working length portion spaced from said clamping length portion; said working length portion having a second diameter; said first diameter being greater than said second diameter;

(c) hooks provided on and along said working length portion; and (d) a transition length portion formed between said clamping and working length portions; said transition length portion including a length region having a diameter decreasing from said first diameter down to said second diameter; said length region of said transition length portion having a length at least twice the length of said working length portion.

2. The felt needle as defined in claim 1, wherein said working and clamping length portions are coaxial.

3. The felt needle as defined in claim 1, wherein said second diameter is constant.

4. The felt needle as defined in claim 1, wherein said first diameter is constant.

5. The felt needle as defined in claim 1, wherein said clamping and transition length portions have a circular cross section.

6. The felt needle as defined in claim 1, wherein said length region of said transition length portion has a length of more than 11 mm.

7. The felt needle as defined in claim 6, wherein the length of said length region is more than 20 mm.

8. The felt needle as defined in claim 1, wherein said length region is conical.

9. The felt needle as defined in claim 8, wherein the conical length region is shaped as a straight, truncated circular cone.

10. The felt needle as defined in claim 8, wherein the conical length region is shaped as a truncated circular cone having a curved generatrix.

11. The felt needle as defined in claim 1, wherein said length region is divided into at least two conical partial length regions.

12. The felt needle as defined in claim 11, wherein the conical partial length regions are shaped as straight, truncated circular cones.

13. The felt needle as defined in claim 11, wherein the conical partial length regions are shaped as truncated circular cones each having a curved generatrix.

14. A combination composed of a felt needle and a needle board; said needle board having a thickness; said felt needle comprising (a) a clamping length portion secured in said needle board; said clamping length portion having a first diameter;

(b) a working length portion spaced from said clamping length portion and being situated at a distance from said needle board; said working length portion having a second diameter; said first diameter being greater than said second diameter;

(c) hooks provided on and along said working length portion; and (d) a transition length portion formed between said clamping and working length portions; said transition length portion including a length region having a diameter decreasing from said first diameter down to said second diameter; said length region having a length extending throughout said distance between said needle board and said working length portion.

* * * * *